US009635465B2

(12) United States Patent
Jacques

(10) Patent No.: US 9,635,465 B2
(45) Date of Patent: Apr. 25, 2017

(54) PLANARDYNAMIC TRANSDUCER

(71) Applicant: Sennheiser electronic GmbH & Co. KG, Wedemark (DE)

(72) Inventor: Roland Jacques, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 14/926,101

(22) Filed: Oct. 29, 2015

(65) Prior Publication Data

US 2016/0173989 A1 Jun. 16, 2016

(30) Foreign Application Priority Data

Oct. 30, 2014 (DE) ..... 10 2014 222 223

(51) Int. Cl.
*H04R 9/02* (2006.01)
*H04R 7/04* (2006.01)
*H04R 9/04* (2006.01)

(52) U.S. Cl.
CPC ..... *H04R 9/025* (2013.01); *H04R 7/04* (2013.01); *H04R 9/047* (2013.01); *H04R 9/02* (2013.01); *H04R 2209/024* (2013.01)

(58) Field of Classification Search
CPC ..... H04R 9/025; H04R 9/047; H04R 9/02; H04R 7/04; H04R 11/00; H04R 11/02; H04R 13/00; G10K 11/002; G10K 11/004
USPC ..... 381/417–419, 421
See application file for complete search history.

(56) References Cited

U.S. PATENT DOCUMENTS

| | | | | |
|---|---|---|---|---|
| 4,837,838 A | 6/1989 | Thigpen et al. | | |
| 5,003,609 A * | 3/1991 | Muraoka | H04R 9/047 | 381/117 |
| 5,003,610 A * | 3/1991 | Adachi | H04R 9/047 | 381/413 |
| 5,361,304 A * | 11/1994 | Jones | H04R 9/047 | 381/401 |
| 6,760,462 B1 * | 7/2004 | Thigpen | H04R 9/047 | 381/408 |
| 8,116,512 B2 * | 2/2012 | Levitsky | H04R 7/04 | 381/399 |
| 2004/0070294 A1 * | 4/2004 | Hanada | H04R 9/047 | 310/81 |

(Continued)

FOREIGN PATENT DOCUMENTS

JP S57148497 9/1982

OTHER PUBLICATIONS

German Search Report for Application No. 10 2015 118 464.8 dated Jun. 6, 2016.

*Primary Examiner* — Davetta W Goins
*Assistant Examiner* — Oyesola C Ojo
(74) *Attorney, Agent, or Firm* — Haug Partners LLP

(57) ABSTRACT

A planar dynamic sound transducer comprising a planar diaphragm having at least one electrical conductor, and a planar magnet arrangement having a first portion, a second portion, and an edge region. The second portion surrounds the first portion and extends between the first portion and the edge region of the magnet arrangement. The first portion contains a first plurality of openings so that the first portion has a first degree of opening. The second portion contains a second plurality of openings so that the second portion has a second degree of opening. The first degree of opening is greater than the second degree of opening.

16 Claims, 2 Drawing Sheets

(56) References Cited

U.S. PATENT DOCUMENTS

| | | | | |
|---|---|---|---|---|
| 2010/0212432 | A1* | 8/2010 | Kasai | H04R 19/005 73/654 |
| 2010/0214047 | A1* | 8/2010 | Sakai | H04R 9/047 335/306 |
| 2012/0087518 | A1* | 4/2012 | Simidian, II | H04R 9/08 381/120 |

* cited by examiner

PLANARDYNAMIC TRANSDUCER

The present application claims priority from German Priority Application No. 10 2014 222 233.0 filed on Oct. 30, 2014, the disclosure of which is incorporated herein by reference in its entirety.

FIELD OF THE INVENTION

The present invention concerns a planar dynamic sound transducer.

Planar dynamic sound transducers are also referred to as planar magnetic, orthodynamic, isodynamic or magnetostatic transducers. The planar dynamic transducer is a member of the group of dynamic electromagnetic sound transducers. A planar dynamic sound transducer has a planar multi-pole magnet arrangement, a diaphragm and a second mirrored multi-pole magnet arrangement. The multi-pole magnet arrangement can have parallel magnet bars with intermediate spaces therebetween. Magnetization of the magnet bars can be in the direction of the short dimension. The two magnet arrangements repel each other, with the consequence that they should be assembled in a structure of a suitable design configuration. That results in strip-shaped magnetic fields, wherein the magenetization direction extends alternately and in particular in the direction of the short dimension of the strips.

The diaphragm between the two magnet arrangements is a flat diaphragm comprising a thin plastic film or a polyester film. Electrical conductors are provided on the diaphragm. The electrical conductors can be for example in the form of a thin wire or a vapor-deposited conductor track. The position and the direction of the electrical conductors is adapted to the magnetic poles of the two magnet arrangements. The conductors can be of a meander-shaped configuration.

FIG. 1 shows a diagrammatic sectional view of a planar dynamic transducer in accordance with the state of the art. The planar dynamic transducer 100 has a diaphragm 110 capable of vibration, with electrical conductor tracks 130. The electrical conductor tracks 130 can be of a meander-shaped configuration. The diaphragm 110 can be in the form of a diaphragm film. The transducer 100 further has a first and a second magnet arrangement 120, 140, the first magnet arrangement 120 being provided above the diaphragm 110 and the second magnet arrangement 140 beneath the diaphragm 110. The first magnet arrangement 120 has a plurality of magnet bars 121-122. The magnet bars 121-122 have first and second magnet bars 121, 122 which alternate and which are each of a different magnetization direction. A corresponding consideration applies to the magnet bars 141, 142 of the second magnet arrangement 140.

FIG. 1 shows magnetic field lines FL and a resulting force 101 on the diaphragm 110.

FIG. 2A shows a plan view of a magnet disk for a planar dynamic transducer in accordance with the state of the art. The magnet disk 300 serves as the magnet arrangement as shown in FIG. 1. The magnet disk 300 has a plurality of bores or openings 301 which are of a constant size or a constant diameter.

FIG. 2B shows a diagrammatic sectional view of a magnet arrangement in accordance with the state of the art. The magnet arrangement 120 has a plurality of magnet bars 121, 122 and an air gap 123 between the magnet bars 121, 122. Both the width of the magnet bars 121, 122 and also the width of the air gap 123 are constant.

An arrangement as shown in FIG. 2B of magnet bars 121, 122 can be placed on the magnet disk 300 in FIG. 2A.

U.S. Pat. No. 4,837,838 discloses a planar dynamic transducer having a planar diaphragm and a planar magnet arrangement of magnetization bars.

SUMMARY OF THE INVENTION

Thus there is provided a planar dynamic sound transducer comprising a planar diaphragm with at least one electrical conductor and a planar magnet arrangement having a first portion, a second portion and an edge region. The second portion surrounds the first portion and extends between the first portion and the edge region of the magnet arrangement. The first portion has a first plurality of openings so that the first portion has a first degree of opening. The second portion has a second plurality of openings so that the second portion has a second degree of opening. The first degree of opening is greater than the second degree of opening.

According to an aspect of the invention the magnet arrangement is provided in the form of a magnet disk or magnet plate having a plurality of openings or slots.

According to a further aspect of the present invention the magnet arrangement has a plurality of magnet bars or magnet units and a plurality of air gaps therebetween. The width of the air gaps in the region of the first portion of the magnet arrangement is greater than in the region of the second portion of the magnet arrangement. Alternatively or additionally thereto the width of the magnet bars in the region of the second portion is greater than in the region of the first portion.

According to a further aspect of the present invention the first portion is arranged spaced at all sides relative to the edge region.

According to a further aspect of the present invention the first portion is of a length and a width, wherein the length and the width of the first portion differ from each other at most by the factor of 2.

According to a further aspect of the present invention the area of the first portion is at most 30% of the area of the magnet arrangement.

The invention also concerns an earphone having a planar dynamic sound transducer as described above.

According to an aspect of the present invention the first portion is so arranged in an earphone that in use of the earphone the first portion is disposed in the proximity of the entry to an ear canal of the user.

An object of the present invention is to provide a planar dynamic sound transducer which has an improved magnet arrangement.

That object is attained by a planar dynamic sound transducer as set forth in claim 1.

Thus there is provided a planar dynamic sound transducer having a planar diaphragm with at least one electrical conductor. The sound transducer also has a planar magnet arrangement having a plurality of openings or slots in the magnet arrangement. A diameter or a width of the openings or the slots of the magnet arrangement at the center is greater than in the edge region of the magnet arrangement.

In accordance with an aspect of the present invention the magnet arrangement is provided in the form of a magnet disk having a plurality of bores, wherein the diameter of the bores in the center of the magnet disk is greater than in an edge region of the magnet disk.

According to a further aspect of the present invention the magnet arrangement has a plurality of magnet bars and a plurality of air gaps. The width of the air gaps in the center is greater than in the edge region and/or the width of the magnet bars is greater in the edge region than in the center.

The planar dynamic sound transducer can be provided in an earphone, a microphone or a loudspeaker.

Further configurations of the invention are subject-matter of the appendant claims.

Advantages and embodiments by way of example of the invention are described in greater detail hereinafter with reference to the drawings.

DETAILED DESCRIPTION OF THE EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein The planar dynamic sound transducer according to the invention, as shown also in FIG. 1, has a diaphragm 110 having at least one electrical conductor 130 and a magnet arrangement 120, 140. The magnet arrangement 120, 140 can be provided above and below the diaphragm 110.

Figure 3A:
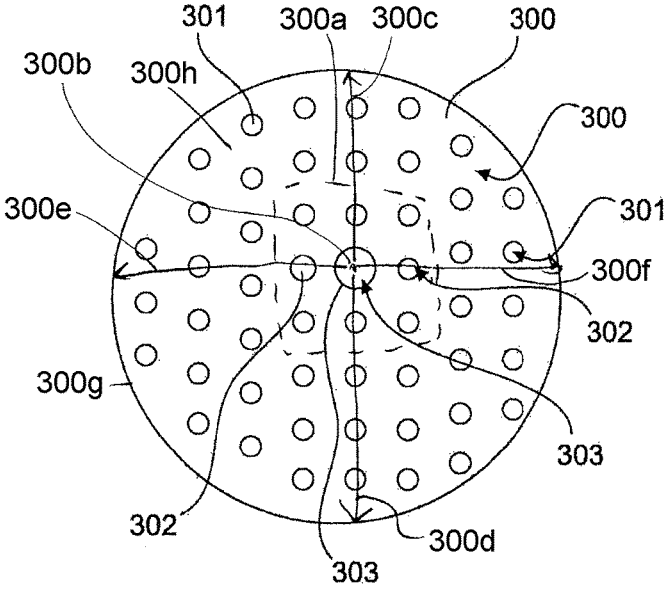
FIG. 3A shows a plan view of a magnet disk for a planar dynamic transducer according to a first embodiment.

FIG. 3A shows a diagrammatic plan view of a magnet disk for a planar dynamic transducer according to a first embodiment. The magnet disk 300 can optionally replace or supplement the first and second magnet arrangements shown in FIG. 1. For that purpose it is only necessary to provide two of the magnet disks 300 shown in FIG. 3A above and below the diaphragm 110. Alternatively it is also sufficient if only one of the two magnet disks belonging to the planar dynamic transducer is of a structure as shown in FIG. 3A. The magnet arrangement 120, 140 can be in the form of a magnet plate or magnet disk.

The invention concerns the notion that the magnet system of a planar dynamic transducer must have openings through which the sound emitted by the diaphragm can issue. The larger the area of the openings the higher therefore is the degree of opening and the corresponding less is the issue of sound disturbed. It will be noted however that an increase in the degree of opening of the sound issue area leads to a reduction in the drive power for the diaphragm as at the openings there is no available magnet material which could contribute to a stronger magnetic field and thus a stronger drive power. The invention concerns a solution for that conflict of aims. For that purpose, use is additionally made of the realization that higher frequencies in the audio range, that is to say for example above 1 kHz, are adversely affected by a low degree of opening to a greater extent than lower frequencies. Because of the shorter wavelength however a relatively small region with a high degree of opening is sufficient to generate and emit the higher frequencies. In contrast a larger area and a greater drive power are advantageous for generating and emitting lower frequencies. At the same time lower frequencies are less adversely affected by a low degree of opening of the sound emission area.

According to the invention therefore there is provided a planar dynamic transducer in which a relatively small region which for example is of less than 30% of the diaphragm area has a higher degree of opening of the magnet system than the rest of the magnet system. In that case the region having the higher degree of opening is preferably flat, for example round, that is to say not elongate. In particular the length and the width of that region differ from each other at most by the factor of 2. In addition that region is preferably arranged spaced from the outer edge of the magnet system so that it is completely surrounded by regions of the magnet system, that have a lesser degree of opening. Overall therefore a small region of the magnet system with a higher degree of opening is available for higher frequencies while for lower frequencies the entire diaphragm area as far as the edge is available, with a lower degree of opening. The transducer can be fitted for example in a headphone. The region having the higher degree of opening is then so provided that in use of the headphone it is in the proximity of the entry to the ear canal of a user.

The magnet disk or plate 300 according to the first embodiment has a plurality of first holes 301, second holes 302 and a third hole 303. The magnet disk 300 has a first portion 300*a* and an edge region 300*g*. Provided between the first portion 300*a* and the edge region 300*g* is a second portion 300*h*, that is to say the second portion 300*h* surrounds the first portion 300*a*.

The first portion 300*a* is arranged spaced at all sides relative to the edge region 300*g*. The first portion 300*a* can be round or angular. The first portion 300*a* can have a center point 300*b*. From the center point 300*b* of the first portion 300*a* there is a first spacing 300*c* (upwardly) relative to the edge region 300*g*, a second portion 300*d* (downwardly) to the edge region 300*g*, a third portion 300*e* (towards the left) relative to the edge region 300*g* and a fourth portion 300*f* relative to the edge region 300*g*. According to an aspect of the present invention the first spacing 300*c* is different relative to the second spacing 300*d*. In particular the first spacing can be less than the second spacing. Thus the center point 300*b* of the first portion 300*a* can be outside the center point of the disk or plate 300. In the first portion 300*a* a degree of opening of the openings or the holes can be greater than in a second portion 300*h* which extends between the edge region 300*g* and the first portion 300*a*. The degree of opening of the openings or holes in the second portion 300*h* is less than the degree of opening of the openings or holes or slots in the first portion 300*a*.

The third hole 303 is preferably provided in the first portion 300*a* of the magnet disk 300. The second bores 302 of a smaller diameter than the third bore 303, that like the third hole 303 are disposed in the first portion 300*a*, can be provided around the third bore 303.

A plurality of first bores 301 can be provided between the second bores 302 and the edge of the disk. The diameter of the first bores 301 is less than that of the second and third bores 302, 303. In that case the diameter of the bores decreases outwardly. The first, second and third bores 301, 302, 303 are respectively so oriented that they are provided within a line.

Figure 3B:
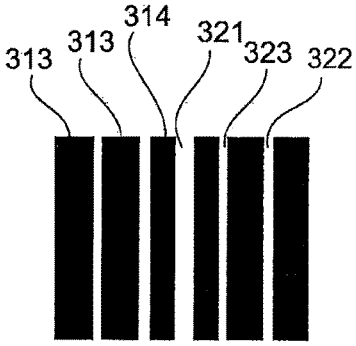
FIG. 3B shows a sectional view of a magnet arrangement for a planar dynamic transducer according to a second embodiment.

FIG. 3B shows a diagrammatic sectional view of a magnet arrangement according to the second embodiment. The magnet arrangement according to the second embodiment can optionally be placed in or on the magnet disk according to the first embodiment of FIG. 3A, or can be provided alone. The magnet arrangement has a plurality of bars and a respective air gap 322, 323 between adjacent bars. Optionally the width of the respective bars 313, 314 is not constant. A corresponding consideration applies to the air gap between adjacent bars. Optionally the width of the magnet bars 313 and the width of the air gaps 321, 322 can be adapted to the hole pattern in the magnet disk 300 so that the magnet bars are placed on the apertured disk 300 without in that case closing off the first, second or third holes 301, 302, 303 (without the disk 300).

The invention concerns the notion that the magnet arrangement must be air- and sound-pervious so that sound can either be delivered or detected.

The invention further concerns the notion that the degree of opening of the holes or air gaps between adjacent magnet bars can vary in dependence on the position of the holes or air gaps. Thus for example the degree of opening of a hole in the center can be greater than that of a hole in the outer region.

Figure 1:
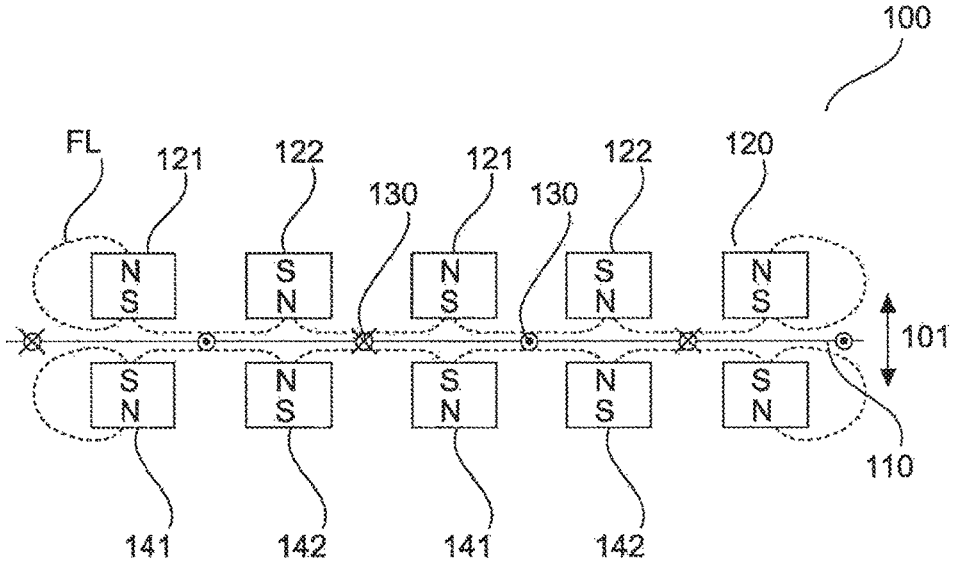
Fig. 1 (prior art)
FIG. 1 shows a diagrammatic sectional view of a planar dynamic transducer according to the state of the art.
Figure 2A:
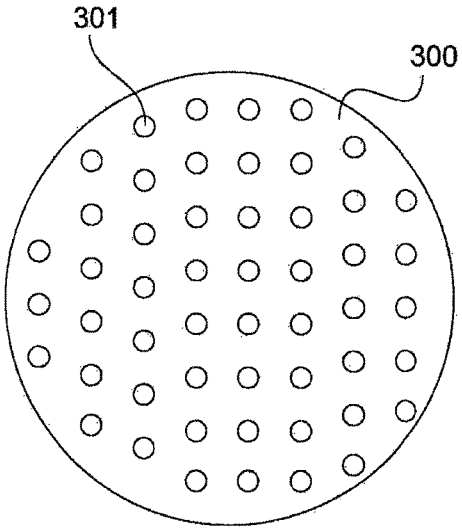
Fig. 2A (prior art)
FIG. 2A shows a plan view of a magnet disk for a planar dynamic transducer according to the state of the art.
Figure 2B:
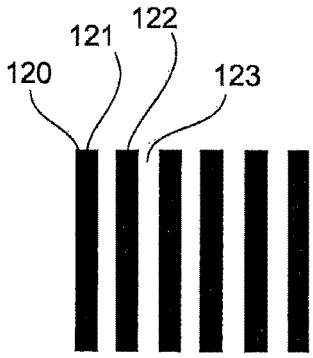
Fig. 2B (prior art)
FIG. 2B shows a diagrammatic sectional view of a magnet arrangement for a planar dynamic transducer according to the state of the art.

In a corresponding fashion the air gap in the inner region can be larger than in the outer region. While the planar dynamic transducer according to the state of the art in FIG. 1 represents a plurality of slots the planar dynamic transducer with the magnet disk 300 according to the first embodiment can have a plurality of holes instead of slots. A degree of opening is the relationship of the area of the opening or the slot relative to the total area of the portion or the region.

According to the invention the magnet arrangement for a planar dynamic transducer can be afforded by bars, rings or by a disk. The magnet arrangement must ensure a certain acoustic transparency, that is to say there must be openings or spacings between the bars, bores in the disk and so forth. The smaller the degree of opening the correspondingly higher is the magnetic remanence flux density and thus a higher drive power can be generated. On the other hand a reduction in the size of the openings or the air gaps of the magnet arrangement has the result that the sound can be more poorly transmitted. That applies in particular to high frequencies. According to the invention it is therefore proposed that the width of the bores or slots of the magnet arrangements is varied in dependence on the position of the openings or slots, wherein larger openings or slots are provided in the center than in the edge region of the magnet arrangement.

The variation in the degree of opening of the magnetic arrangement provides that acoustic transparency can also be improved for high frequencies. That can be effected in particular in the center of the transducer or in the proximity of the ear canal in the case of a headphone. On the other hand, a drive power can be increased in those regions which have smaller openings or slots.

It is further possible to achieve improved distribution of the acoustic load on the diaphragm. That is advantageous because in that way it is possible to suppress vibration modes and the piston-like nature of the diaphragm movement can be improved.

According to the invention care is to be taken to ensure that a compromise between the increase in drive power and the acoustic demands is achieved. That is to be seen in particular from the fact that the degree of opening cannot be reduced just as desired. On the other hand a reduction in the degree of opening also leads to an increased mass for the magnet arrangement, which in turn makes the overall sound transducer heavier. In addition the drive power of the transducer is lower in the region of the higher degree of opening because there is less magnet mass there.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claim.

The invention claimed is:

1. A planar dynamic sound transducer comprising:
a planar diaphragm having at least one electrical conductor; and
a planar magnet arrangement comprising:
a first portion containing a first plurality of openings having a first degree of opening;
a second portion containing a second plurality of openings having a second degree of opening; and
an edge region;
wherein the second portion surrounds the first portion and extends between the first portion and the edge region;
wherein the first degree of opening is greater than the second degree of opening;
wherein the magnet arrangement has a plurality of magnet bars and a plurality of air gaps; and
wherein:
a width of the air gaps in a region of the first portion of the magnet arrangement is greater than the width of the air gaps in a
region of the second portion of the magnet arrangement; and/or
a width of the magnet bars in the region of the second portion is greater than the width of the magnetic bars in the region of
the first portion.

2. The planar dynamic sound transducer as set forth in claim 1;
wherein the magnet arrangement is provided in the form of a magnet disk or magnet plate having a plurality of openings or slots.

3. The planar dynamic sound transducer as set forth in claim 1;
wherein the first portion is configured to be spaced at all sides relative to the edge region.

4. The planar dynamic sound transducer as set forth in claim 1;
wherein the first portion has a length and a width; and
wherein the length and the width of the first portion differ from each other by at most a factor of 2.

5. The planar dynamic sound transducer as set forth claim 1;
wherein the area of the first portion is at most 30% of the area of the magnet arrangement.

6. An earphone comprising:
a planar dynamic sound transducer as set forth in claim 1.

7. The earphone as set forth in claim 6;
wherein the first portion is configured to be disposed in proximity of an entry to an ear canal of a user when the earphone is in use.

8. A microphone comprising:

a planar dynamic sound transducer as set forth in claim 1.

9. A loudspeaker comprising:

a planar dynamic sound transducer as set forth in claim 1.

10. A planar dynamic sound transducer comprising:

a planar diaphragm having at least one electrical conductor; and a planar magnet arrangement comprising:

a first portion containing first magnet bars and first air gaps between the first magnet bars, the first portion having a first degree of opening; and a second portion containing second magnet bars and second air gaps between the second magnet bars, the second portion having a second degree of opening;

wherein the first portion has a length and a width that differ from each other;

wherein the first air gaps between the first magnet bars are broader than the second air gaps between the second magnet bars; and wherein the first degree of opening is greater than the second degree of opening.

11. The planar dynamic sound transducer as set forth in claim 10:

wherein the second magnet bars are broader than the first magnet bars.

12. A planar dynamic sound transducer comprising:

a planar diaphragm having at least one electrical conductor; and a planar magnet arrangement comprising:

a first portion containing first magnet bars and first air gaps between the first magnet bars, the first portion having a first degree of opening; and a second portion containing second magnet bars and second air gaps between the second magnet bars, the second portion having a second degree of opening;

wherein the first portion has a length and a width that differ from each other;

wherein the second magnet bars are broader than the first magnet bars, and wherein the first degree of opening is greater than the second degree of opening.

13. A microphone comprising:

a planar dynamic sound transducer as set forth in claim 10.

14. A headphone comprising:

a planar dynamic sound transducer as set forth in claim 10.

15. A microphone comprising:

a planar dynamic sound transducer as set forth in claim 12.

16. A headphone comprising:

a planar dynamic sound transducer as set forth in claim 12.

* * * * *